US010281186B2

(12) United States Patent
Inamori

(10) Patent No.: US 10,281,186 B2
(45) Date of Patent: May 7, 2019

(54) ICE MAKER EJECTION MECHANISM

(71) Applicant: Oxen, Inc., Fayetteville, GA (US)

(72) Inventor: Reijiro Inamori, Peachtree City, GA (US)

(73) Assignee: Oxen, Inc., Fayetteville, GA (US)

( * ) Notice: Subject to any disclaimer, the term of this patent is extended or adjusted under 35 U.S.C. 154(b) by 85 days.

(21) Appl. No.: 15/668,973

(22) Filed: Aug. 4, 2017

(65) Prior Publication Data

US 2019/0041113 A1 Feb. 7, 2019

(51) Int. Cl.
*F25C 1/12* (2006.01)
*F25C 5/04* (2006.01)

(52) U.S. Cl.
CPC ..... *F25C 1/12* (2013.01); *F25C 5/04* (2013.01); *F25C 2305/022* (2013.01)

(58) Field of Classification Search
CPC ..... F25C 1/12; F25C 1/00; F25C 1/04; F25C 1/10; F25C 2400/06; F25C 5/04; F25C 2305/022
See application file for complete search history.

(56) References Cited

U.S. PATENT DOCUMENTS 5,941,091 A * 8/1999 Broadbent ..... F25B 39/024 165/135
6,205,807 B1 * 3/2001 Broadbent ..... F25B 39/022 62/347
2006/0191281 A1 * 8/2006 Feldman ..... F25B 39/02 62/340
2014/0182314 A1 * 7/2014 Hoti ..... F25C 1/12 62/71
2016/0298892 A1 * 10/2016 Matsumoto ..... F25C 1/12
2016/0298894 A1 * 10/2016 Matsumoto ..... F25C 5/10

* cited by examiner

*Primary Examiner* — Emmanuel Duke
(74) *Attorney, Agent, or Firm* — Thomas | Horstemeyer, LLP

(57) ABSTRACT

An ice making system and method that includes an ice formation tray, an ejector, and an ejector shaft is disclosed herein. The ice formation tray has a first side and a second side. The ejector includes a unitary structure and an insert, with the unitary structure encompassing the insert on at least four sides. The ejector shaft spans between the first side and the second side of the ice formation tray, with the ejector shaft passing through a bore in the insert of the ejector.

24 Claims, 18 Drawing Sheets

ICE MAKER EJECTION MECHANISM

BACKGROUND

An icemaker can refer to a commercial or consumer device for making ice. The icemaker can generate ice cubes by freezing liquid water. The ice cubes can be used to chill or prevent spoilage of perishable items, such as food, beverages, and medicine. An evaporator can be included in the icemaker along with controls and a subframe that are directly involved with making and ejecting ice. The ejected ice can be ejected into an ice storage.

Icemakers can generate various types of ice, such as flake ice, cubed ice, or tubed ice. Flaked ice can be made of a mixture of brine and water, and in some cases be directly made from brine water. A tube icemaker can generate ice by freezing water in tubes that are extended vertically within a surrounding casing. Cube icemakers can be classified as small ice machines, in contrast to tube icemakers and flake icemakers. However, cubed icemakers can also be built at a larger scale. An icemaker that creates cubed ice can be seen as a vertical modular device. The upper part is an evaporator and the lower part is an ice bin. Refrigerant can be circulated inside of pipes. The refrigerant conducts heat from water on a heat exchange. The water can freeze into ice cubes. When the water is thoroughly frozen into ice, the ice can be released to fall into an ice bin.

SUMMARY

The present disclosure presents a system and method for the formation and removal of ice pieces. The system can include an ice formation tray, an ejector, and an ejector shaft. The ice formation tray can include a first side and a second side. The ejector can include a unitary structure and an insert. The unitary structure can encompass the insert on at least four sides. The ejector shaft can span between the first side and the second side of the ice formation tray. The ejector shaft can pass through a keyed aperture in the insert of the ejector.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Described below are various embodiments of the present system and method for an ice maker, such as an ice maker for commercial use. In the following discussion, a general description of the system and its components is provided, followed by a discussion of the operation of the same. Although particular embodiments are described, those embodiments are mere exemplary implementations of the system and method. One skilled in the art will recognize other embodiments are possible. All such embodiments are intended to fall within the scope of this disclosure. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

Figure 1:
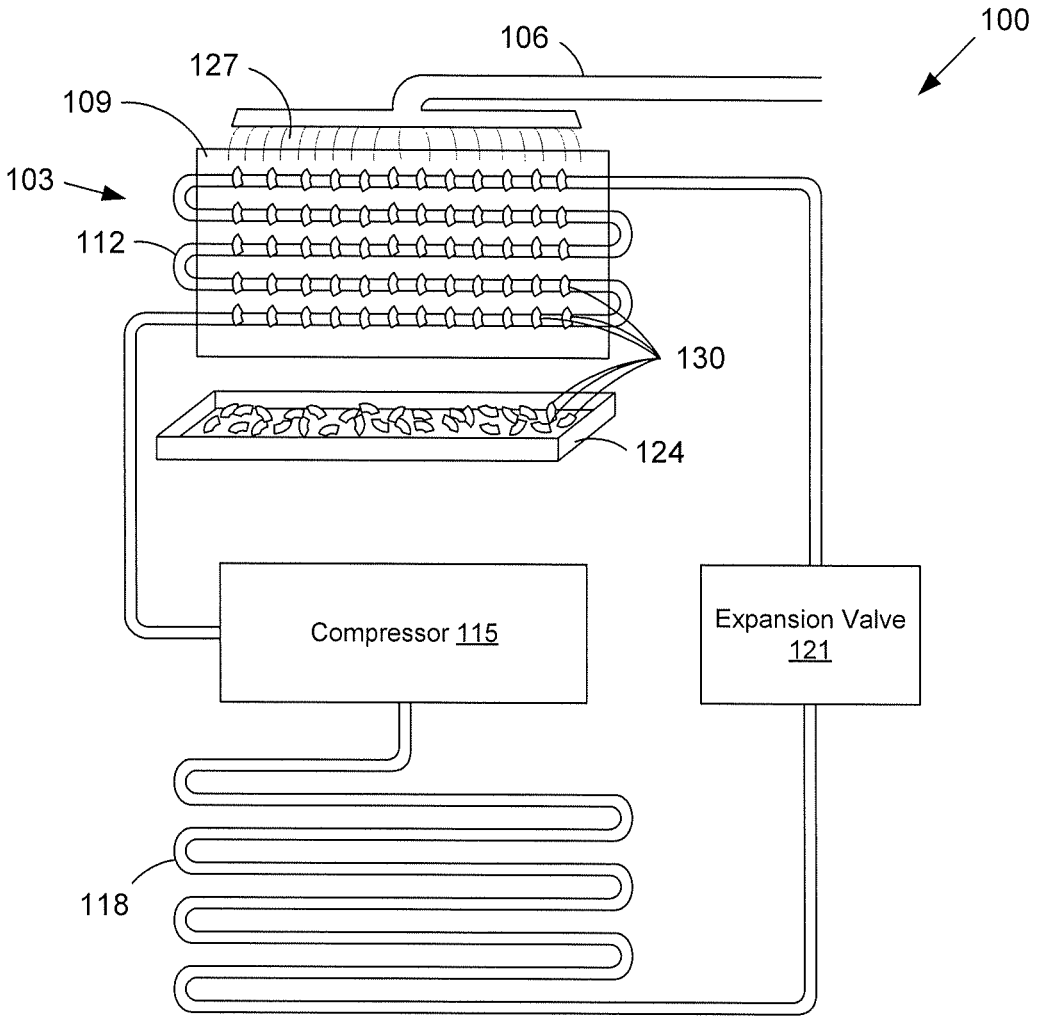
FIG. 1 is a schematic diagram of an example of an ice making system according to various embodiments of the present disclosure.

With reference to FIG. 1, shown is a schematic diagram of an example of an ice making system 100 according to various embodiments of the present disclosure. The ice making system 100 can be used in conjunction with ice formation units shown herein or with other systems, as will be described. In some embodiments, the ice making system 100 can be a part of a self-contained system that generates and stores the ice pieces that are generated; the ice pieces are hereinafter referred to as ice pieces 130.

The ice making system 100 can include an ice formation assembly 103, a compressor 115, an expansion valve 121, a water supply 106, an ice bin 124, and possibly other components. The water supply 106 can provide a liquid water stream 127 that is used for the formation of the ice pieces 130. To this end, the water supply 106 can be in communication with a faucet, hose, valve, spigot, or any other type of water connection at, for example, a building structure. In some embodiments, the water supply 106 can include filters or other components to remove contaminants from the water provided by the building structure. According to various embodiments, the water stream 127 can be water that is dripped, squirted, sprayed, misted, or supplied in any other fashion to the ice formation assembly 103.

The ice formation assembly 103 can be a portion of the ice making system 100 where the ice pieces 130 are generated. In various embodiments, the ice formation assembly 103 can include one or more ice formation trays 109, one or more evaporator tubes 112, and possibly other components. The ice formation tray 109 is a component of the ice formation assembly 103 that receives the water stream 127. The ice formation tray 109 can determine or influence the shape of the ice pieces 130 that are generated. According to some embodiments, the ice formation tray 109 can include one or more ice formation cells (not shown).

As will be discussed further below, the evaporator tube 112 can be disposed within at least a portion of the ice formation tray 109. In this sense, the evaporator tube 112 can extend through the ice formation tray 109. The evaporator tube 112 can be a hollow structure that receives and routes a refrigerant. The hollow structure can include internal rifling within the evaporator tube 112. The internal rifling can cause the refrigerant to swirl within the hollow structure, which can more evenly distribute heat throughout the refrigerant. The evaporator tube 112 can be made from metal or other food safe material, for example stainless steel, tin-dipped copper, etc.

The refrigerant can be any type of fluid that is used in a refrigerating cycle, as can be appreciated by a person having ordinary skill in the art. The ice making system 100 can exploit physical properties of the refrigerant to lower the temperature of the evaporator tube 112 to a level that is capable of freezing at least a portion of the water stream 127. Thus, the evaporator tube 112 can be configured to freeze at least a portion of the water stream 127 that comes into direct contact with the evaporator tube 112. As an example, the refrigerant can absorb heat energy through the evaporator tube 112 to lower the temperature of the at least a portion of the water stream 127 to meet or be below a freezing point.

The compressor 115 is in communication with the evaporator tube 112 and a condenser tube 118. In one embodiment, the compressor 115 pressurizes the refrigerant within a condenser tube 118 to generate a pressure difference between the evaporator tube 112 and the condenser tube 118. The compressor 115 can be a subsystem of the ice making system 100 that is configured to receive the refrigerant from the evaporator tube 112 and compress the refrigerant into the condenser tube 118. As such, the condenser tube 118 can be a hollow structure that receives and routes the refrigerant at a pressure that is higher than the pressure of the refrigerant in the evaporator tube 112.

The expansion valve 121 can be a subsystem of the ice making system 100 that controls the refrigerant transitioning from the condenser tube 118 to the evaporator tube 112. As will be discussed later, the transition of the refrigerant at a relatively high pressure in the condenser tube 118 to a relatively lower pressure in the evaporator tube 112 can lower the temperature of the evaporator tube 112 and thereby facilitate generation of the ice pieces 130.

Next, a general description of the operation of the various components of the ice making system 100 is provided. It is assumed that the ice making system 100 is powered, that the water stream 127 is flowing, and that the evaporator tube 112 is supplied with the refrigerant.

The compressor 115 can pump the refrigerant from the evaporator tube 112 to the condenser tube 118. By forcing the refrigerant into the condenser tube 118, the pressure within the condenser tube 118 will rise. The heat generated by the compression of the refrigerant fluid can be transferred to the condenser tube 118, where some of the heat can be dissipated into the ambient environment.

With the refrigerant at a relatively high pressure in the condenser tube 118, the expansion valve 121 can facilitate at least a portion of the high-pressure refrigerant fluid in the condenser tube 118 transitioning to the evaporator tube 112. Because of the relatively low-pressure state in the evaporator tube 112, the refrigerant can decompress and expand at the outlet of the expansion valve 121 upon being exposed to the evaporator tube 112. This decompression of the refrigerant fluid results in the temperature of the evaporator tube 112 being lowered.

The compressor 115 can then again compress the refrigerant from the evaporator tube 112 into the condenser tube 118, and the refrigeration cycle described above can be repeated. Thus, the temperature of the evaporator tube 112 can be reduced to a level that is capable of freezing water in the water stream 127.

Figure 2:
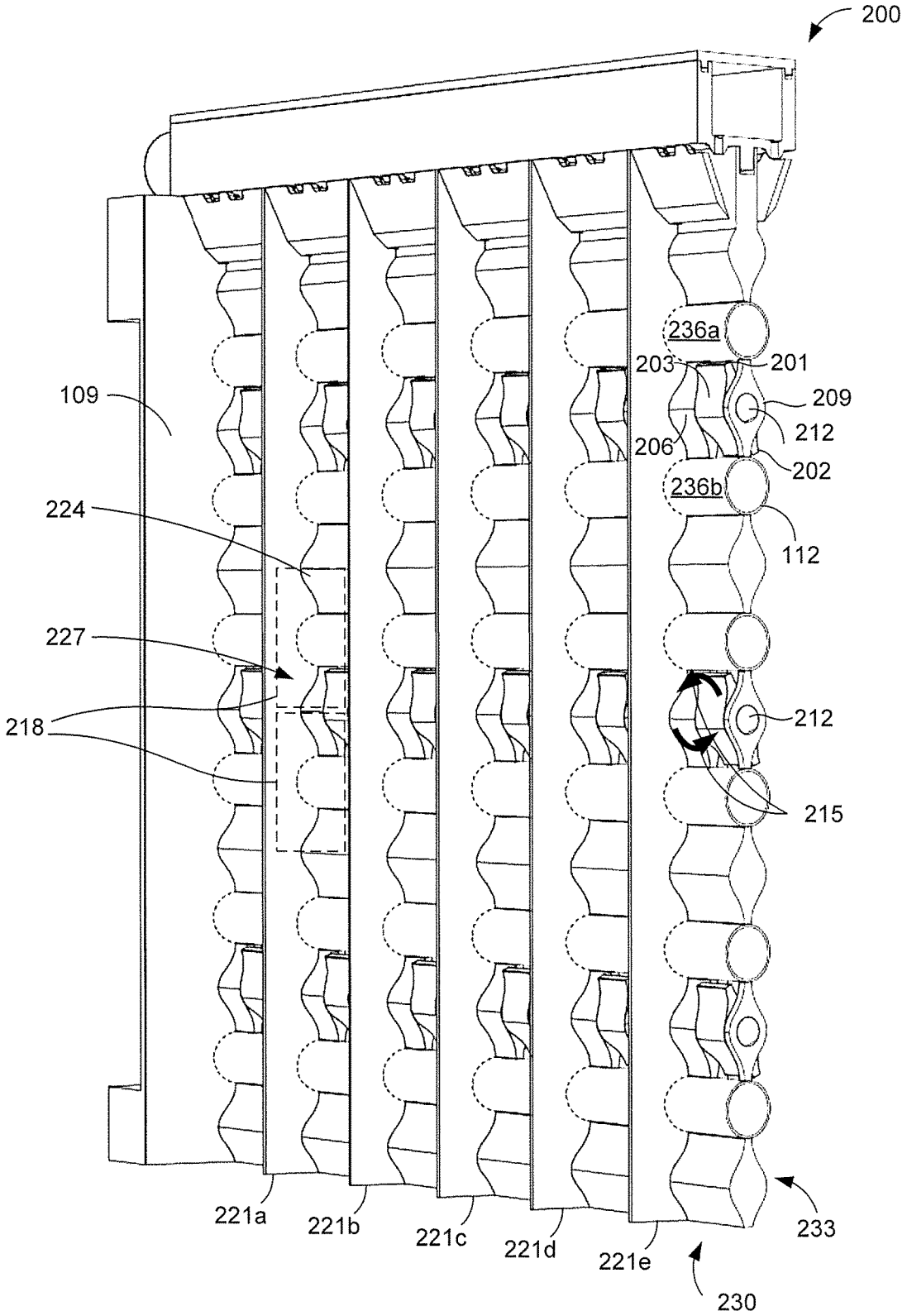
FIG. 2 is an example of the ice formation assembly performing a maneuver to remove ice pieces (not shown) according to various embodiments of the present disclosure.

Turning to FIG. 2, shown is an example of the ice formation assembly 200 performing a maneuver to remove ice pieces 130 (not shown) from the ice formation tray 109 and the evaporator tube 112. The ice formation assembly 200 can be an ice formation assembly 103 of an ice making system 100 (FIG. 1). The ice formation assembly 200 can include an ice formation tray 109, a portion of the evaporator tube 112, and ejectors 203 mounted on an ejection shaft 212.

As will be discussed further below, the evaporator tube 112 can be disposed within at least a portion of the ice formation tray 109. Individual ice pieces (not shown) can be formed within an ice formation cell 218. An ice formation cell 218 can include at least a portion of an evaporator tube 112 and two walls, which can be dividers 221. An ice formation cell 218 can further include a stationary bevel 224 and an ejection bevel 227. The stationary bevel 224 can also be a flat surface, which can be referred to as a stationary panel. In some embodiments, water is unable to freeze along the stationary panel during an ice making cycle because the water directly contacts with the evaporator tube 112 to cool the water quickly. As such, using a stationary panel combined with water directly contacting the evaporator tube can provide for increased water flow to the ice formation cells 218 while mitigating ice accumulation along the stationary panel. In another embodiment, the stationary bevel 224 includes a horizontal ridge.

In various embodiments, an ejection bevel 227 includes an ejector 203. In some aspects, an ejection bevel 227 can further include a first partial bevel 206 and a second partial bevel 209, where an ejector 203 is disposed between a first partial bevel 206 and a second partial bevel 209. In some embodiments, the ejection bevel 227 is substantially the same shape as the stationary bevel 224. In an example, an ice formation cell 218 can include a portion of a first divider 221*a* and a portion of a second divider 221*b*, a portion of a stationary bevel 224 and a portion of an ejection bevel 227, with a portion of an evaporator tube 112 disposed between the stationary bevel 224 and the ejection bevel 227. The ice formation assembly 200 has a first side 230 and a second side 233, which allow ice pieces to form in ice formation cells 218 on both sides simultaneously.

Although the following description makes reference to only one of the ejectors 203, it is understood that a similar process can be performed by the other ejectors 203 as well. The ice formation assembly 200 shows an ejector 203 surrounded by a first partial bevel 206 and a second partial bevel 209. The ejector 203 can be rotated to remove two ice pieces 130. In particular, FIG. 2 shows the rotation of the ejector 203 that can remove two ice pieces 130 from the ice formation tray 109 and the evaporator tube 112. To this end, the ejector shaft 212 can rotate in the direction as indicated by the arrows 215.

In some embodiments, the ejector shaft 212 can rotate the ejector 202 in a first direction by a first amount and rotate the ejector 202 in the other direction by a second amount. The second amount can be twice as high as the first amount with a first half of the second amount corresponding to a return of the ejector shaft 212 to a neutral position. In one example, the ejector shaft 212 rotates in the first direction by forty degrees to pry a first set of ice pieces. Then, the ejector shaft 212 rotates in the opposite direction by forty degrees to return to a neutral position. Next, the ejector shaft 212 rotates another forty degrees in the opposite direction to pry a second set of ice pieces. Then, the ejector shaft 212 rotates in the first direction by forty degrees to return to the neutral position. In yet another embodiment, the ejector shaft 212 rotates between thirty and fifty degrees in the first direction, returns to the neutral position, rotates between thirty and fifty degrees in the other direction, and returns to the neutral position.

Because the ejector 203 rotates in conjunction with the ejector shaft 212, a first end 201 of the ejector 203 is displaced with respect to a first straight segment 236*a* of the evaporator tube 112. Simultaneously, a second end 202 of the ejector 203 is displaced with respect to a second straight segment 236*b* of the evaporator tube 112. As shown, the displacement of the first end 201 of the ejector 203 is in an opposite direction of the displacement of the second end 202 of the ejector 203. The displacement of the first end 201 of the ejector 203 can pry a first ice piece 130 (not shown) away from the first straight segment 213*a* of the evaporator tube 112 and a first side 230 of the ice formation tray 109. Similarly, the displacement of the second end 202 of the ejector 203 can pry a second ice piece 130 (not shown) away from the second straight segment 213*b* of the evaporator tube 112 and the second side 233 of the ice formation tray 109. When the ice pieces 130 are removed from the evaporator tube 112 and the ice formation tray 109, the ice pieces 130 can fall, for example, into the ice bin 124.

Figure 3:
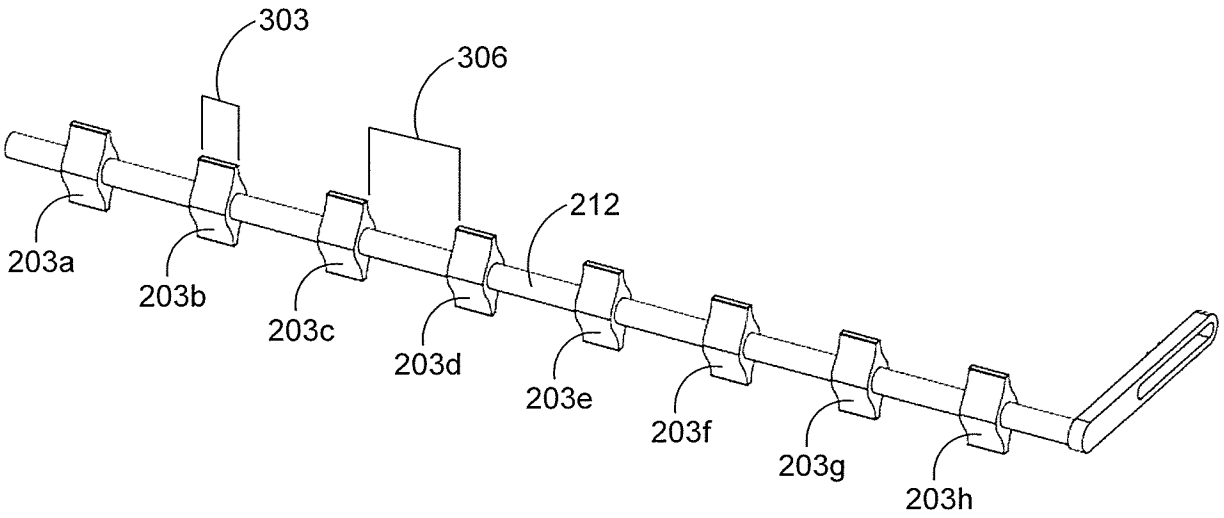
FIG. 3 is a drawing of multiple ejectors mounted to an ejector shaft for the ice formation assembly of FIG. 2 according to various embodiments of the present disclosure.

With reference to FIG. 3, shown is a drawing of multiple ejectors 203, referred to herein as ejectors 203*a*-203*h*, which are mounted on an ejector shaft 212. The ejector shaft 212 with ejectors 203 can be part of the ice formation assembly 103 and configured to form an ejection bevel 227 when assembled with at least an ice formation tray 109. The ejectors 203 can have an ejector width 303. The ejectors 203 can be spaced apart by a separation distance 306. The cross section of the ejector shaft 242 can be D-shaped, square, hexagonal, or other shape that will allow free rotation within a bore of the ice formation tray 109. The ejector shaft 212 can be configured to insert into one of the bores in the side of the ice formation tray 109 (not shown). Additionally, the ejector shaft 212 can rotate about an axis defined by the ejector shaft 212. To this end, an end of the ejector shaft 212 can be fixedly connected to a link. The link can include a slot to facilitate the rotation of the ejector shaft 212.

Figure 4A:
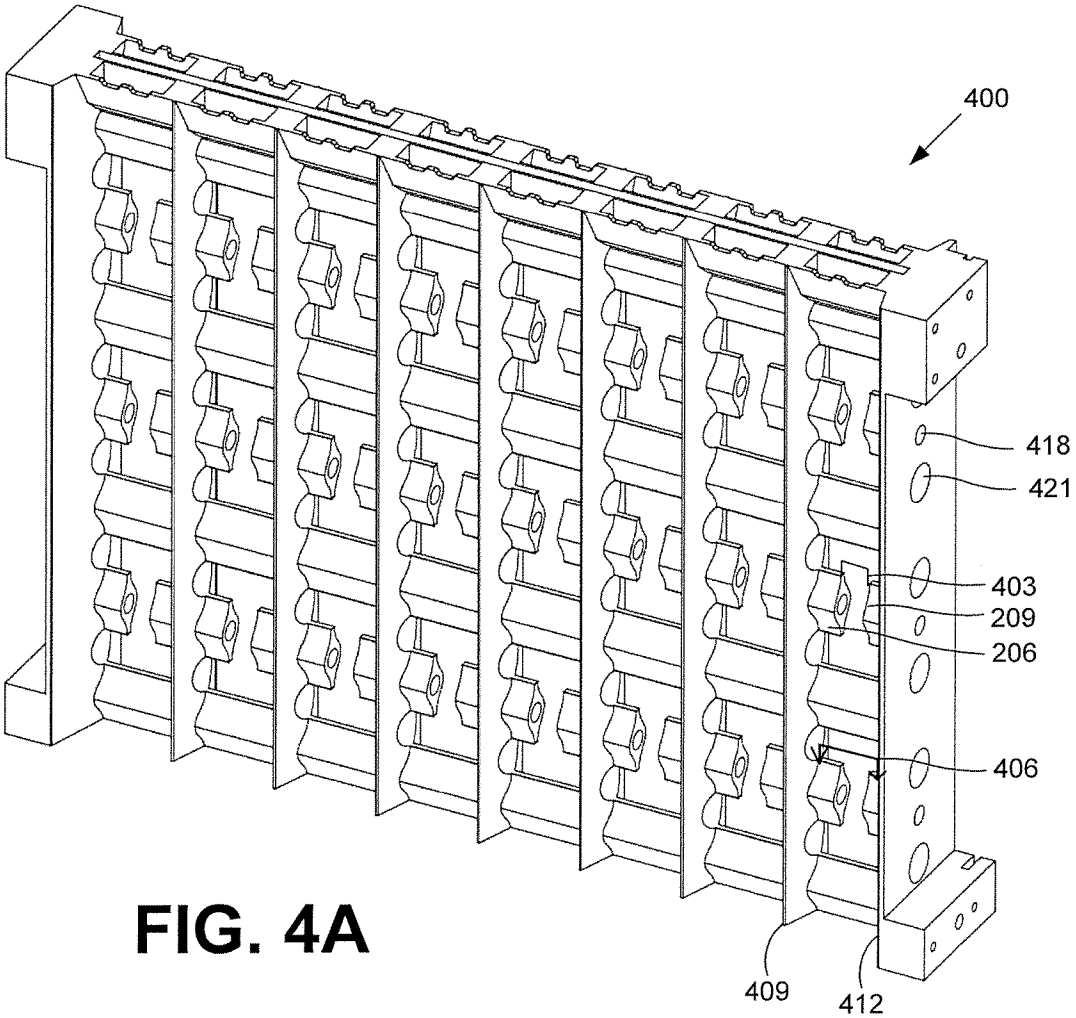
FIGS. 4A-4C illustrate an ice formation assemblies with various gap widths according to various embodiments of the present disclosure.

Turning to FIG. 4A, shown is an example of an ice formation tray 400 for the ice making system 100 (FIG. 1) according to various embodiments of the present disclosure. The ice formation tray 400 shows an ejector gap 403 where an ejector 203 is removed between the first partial bevel 206 and the second partial bevel 209. The divider gap 406 refers to a span of a space between dividers 221; for example, between a divider 409 and a divider 412. When assembled with ejectors 203 to form ejection bevels 227, the ejector gap 403 is substantially the width 303 of ejector 203, where the ejector width 303 is less than the ejector gap 403 by a specified clearance. An ejector shaft 212 (not shown) can be inserted in a small bore (e.g. small bore 418) to dispose the ejectors 203 in the ejector gaps 403 and provide a means to rotate the ejectors 203. An evaporator tube 112 (not shown) can be inserted through a large bore (e.g. large bore 421) as part of the ice formation assembly 109.

The ejector gap 403 can be thirty percent of the distance of the divider gap 406. An ejector 203 can have an ejector width 303 that is substantially equal to the distance of ejector gap 403. According to one example embodiment, the ejector width 303 is substantially equal to the distance of ejector gap 403. In this example, the ejector width 303 can be smaller by 1 millimeter or less than the distance of ejector gap 403. The ice formation assembly 200 (FIG. 2) can include ice formation trays 400 and an ejector 203 with a width substantially similar to the distance of ejector gap 403. When ice pieces 130 freeze in an ice formation cell 218, the ice pieces 130 may need a force to detach from the ice formation cell 218. A sheering force can detach the ice piece 130 from the divider 409 and 412. A force can be applied to break away from at least the stationary bevels 224 and the evaporator tubes 112.

A breakaway force can detach the ice piece 130 from the ejector 203, the first partial bevel 206, and the second partial bevel 209. The rotational force of the ejector 203 during rotation can pry away the ice piece from the ejector 203. This rotational force can reduce the breakaway force needed to detach the ice piece 130 from the ejector 203. However, because the first partial bevel 206 and the second partial bevel 209 do not rotate, the breakaway force is not reduced by the rotational force from the ejector. The breakaway force needed to separate the ice piece 130 from the first partial bevel 206 and the second partial bevel 209 can reduce the size of or remove the first partial bevel 206 and the second partial bevel 209.

Figure 4B:
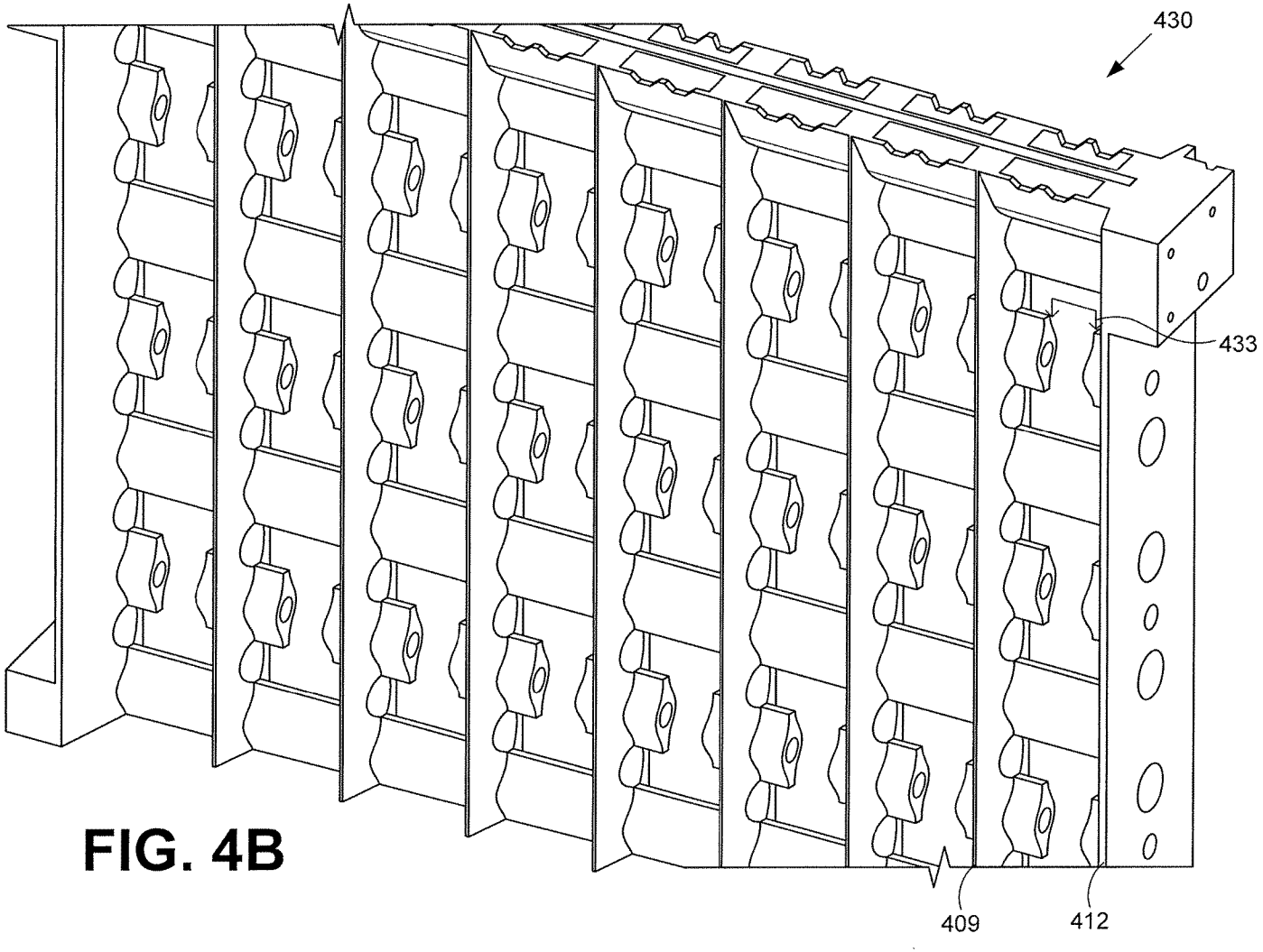

Turning to FIG. 4B, shown is an example of an ice formation tray 430 for the ice making system 100 (FIG. 1) according to various embodiments of the present disclosure. The ice formation tray 430 can include an ejector gap 433 that is wider than ejector gap 403 of ice formation tray 400. In one embodiment, the ejector gap 433 can be at least forty percent of the distance of the divider gap 406. In another embodiment, the ejector gap 433 can be at least sixty percent of the distance of the divider gap 406. In yet another embodiment, the ejector gap 433 can be at least eighty percent of the distance of the gap 406 (FIG. 4A). Increasing the width of the ejector gap 433 and the ejector width 303 increases the surface area of the ejector that encounters the ice piece 130. Increasing the width also decreases the surface area of the first partial bevel 206 and the second partial bevel 209 that encounters the ice piece 130. Accordingly, the force needed to remove an ice piece 130 can be reduced by increasing the ejector width 303 and/or reducing the width of first partial bevel 206 and second partial bevel 209.

The ice formation assembly 200 (FIG. 2) can include ice formation trays 430 and an ejector 203 with a width substantially similar to the distance of the ejector gap 433. When ice pieces 130 freeze in an ice formation cell 218, the ice pieces 130 can require a force to detach from the ice formation cell 218. A sheering force can detach the ice piece 130 from the divider 409 and 412. A force can break away from at least the stationary bevels 224 and the evaporator tubes 112.

Figure 4C:
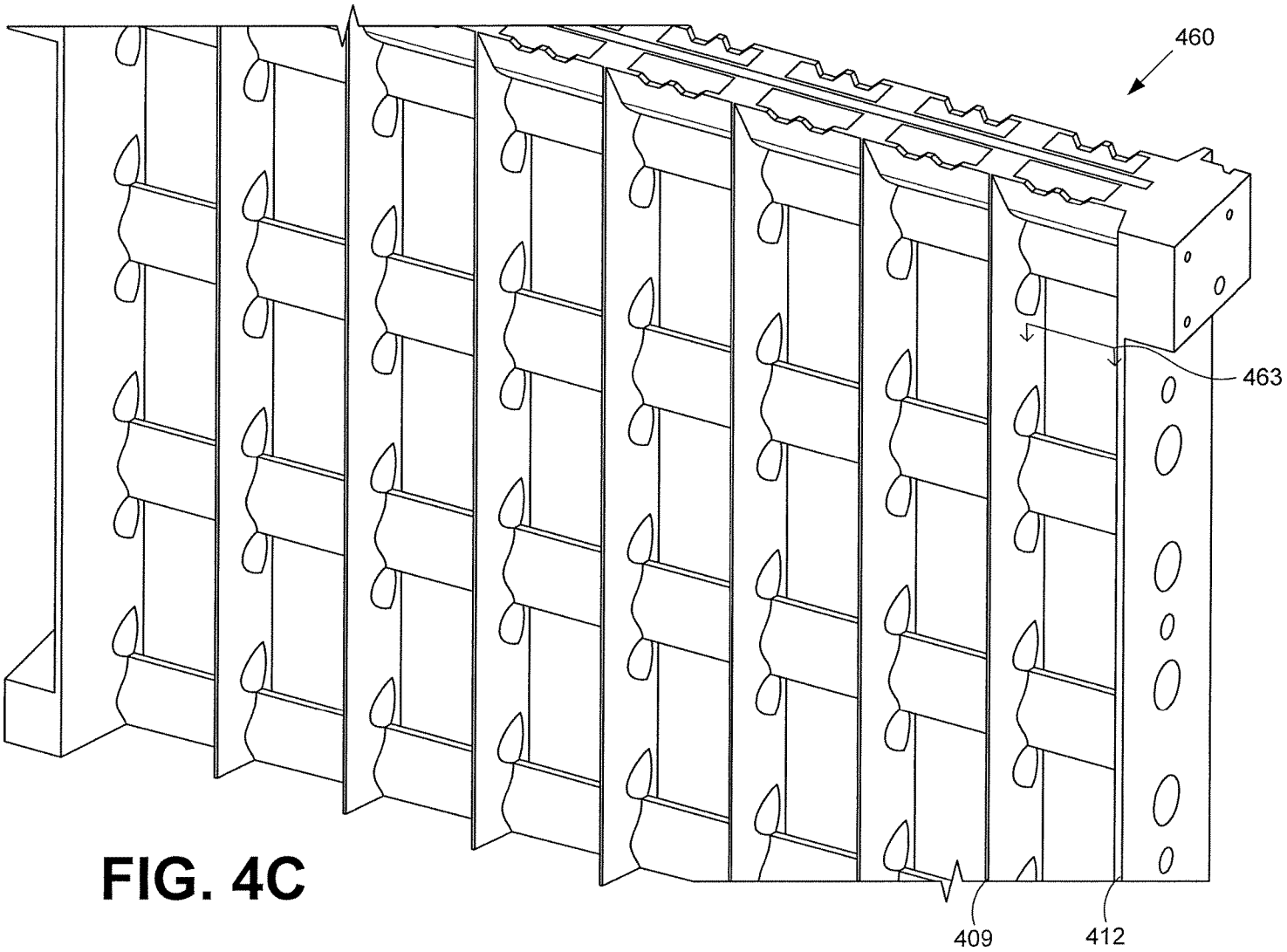

Turning to FIG. 4C, shown is an example of an ice formation tray 460 for the ice making system 100 (FIG. 1) according to various embodiments of the present disclosure. The ice formation tray 460 can include an ejector gap 463. The ice formation tray 460 can omit the partial bevels, such as the first partial bevel 206 and the second partial bevel 209, for example, so that the ejector gap 463 spans between a divider 409 and a divider 412. The ejector width 303 can be substantially similar to the size of ejector gap 463. In the ice formation cells 218 formed between two dividers 409/412, the ejectors 203 can provide the shearing force to break ice pieces 130 free from the dividers 409/412. The ejectors 203 can provide both a breakaway force and a rotational/prying force to break ice pieces 130 free from the ejectors 203, among other forces. In the ice formation tray 460, the amount of force needed to dislodge ice pieces 130 can be drastically reduced in contrast to the ice formation tray 400 and 430 by removing the bevels, such as the partial bevels 206 and 209.

Figure 5A:
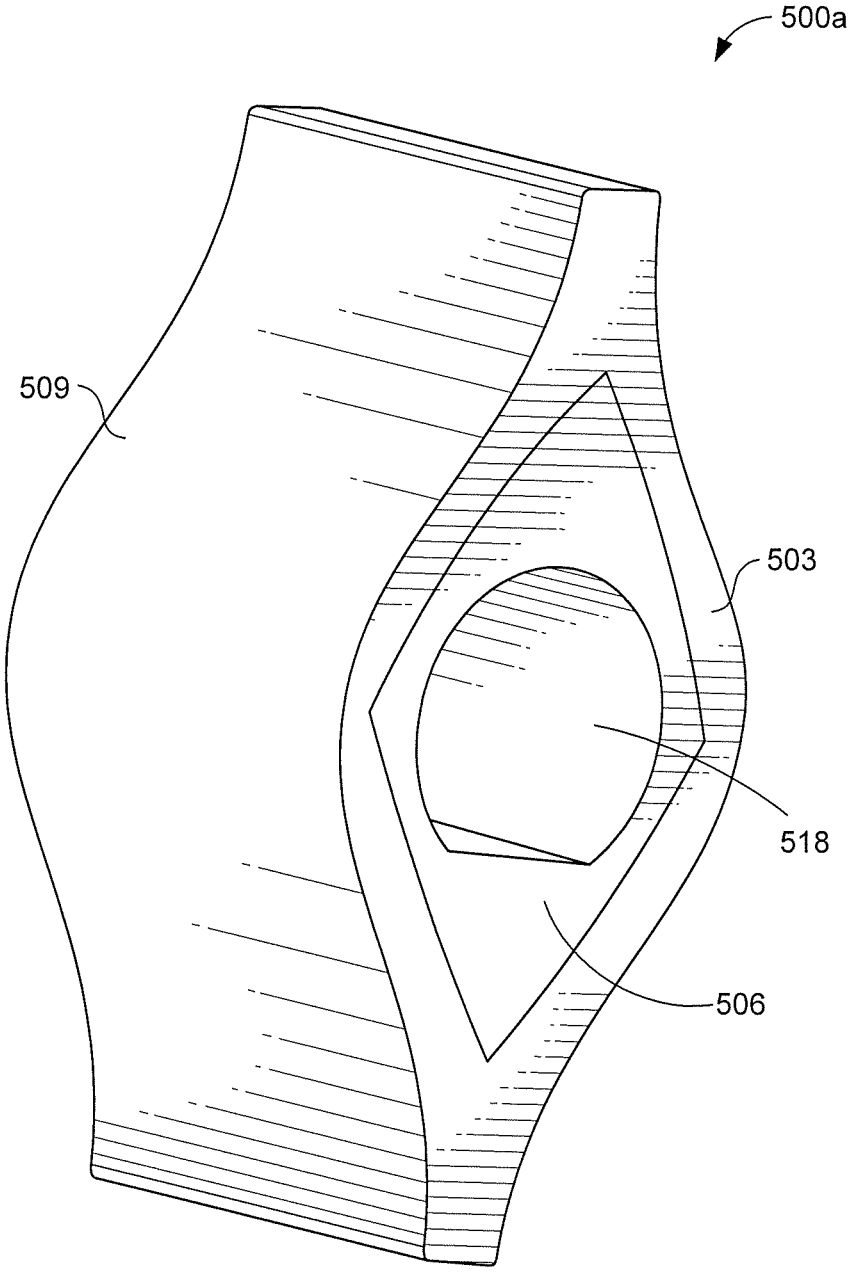
FIGS. 5A and 5B illustrate an example of an ejector configured for an insert with a substantially diamond shaped cross section to be mounted on an ejector shaft of FIG. 3, according to various embodiments of the present disclosure.

Referring next to FIG. 5A, shown is an ejector 500*a* for the ice making system 100 (FIG. 1) according to various example embodiments of the present disclosure. FIG. 5A shows the ejector 500*a* assembled. The ejector 500*a* can be an ejector 203 in an ice formation assembly 200 (FIG. 2). The ejector 500*a* can be sized to correspond to the ejector gap 403, 433 or 463 of an ice formation tray 400, 430, or 460. Although shown with a single width, the width of ejector 500*a* can be narrower or wider to substantially span an ejector gap in an ice formation cell. The ejector 500*a* can include a unitary structure 503 with an insert 506. The unitary structure 503 can have a beveled surface 509 that water contacts. The insert 506 can included a keyed aperture 518. The water can freeze on the beveled surface 509 to create ice pieces 130 within an ice formation cell 218.

The insert 506 is made from a different material from the unitary structure 503. In some embodiments, the insert 506 is made of a material with a higher density than the unitary structure 503. The insert 506 can be a metal alloy or other material. The unitary structure 503 can be made of plastic, rubber, polymer, or other material. According to one embodiment, the insert 506 is placed into an ejection mold, and the unitary structure 503 is formed by injecting a material around the insert 506. In another embodiment, the insert 506 is pressed into the unitary structure 503.

Figure 5B:
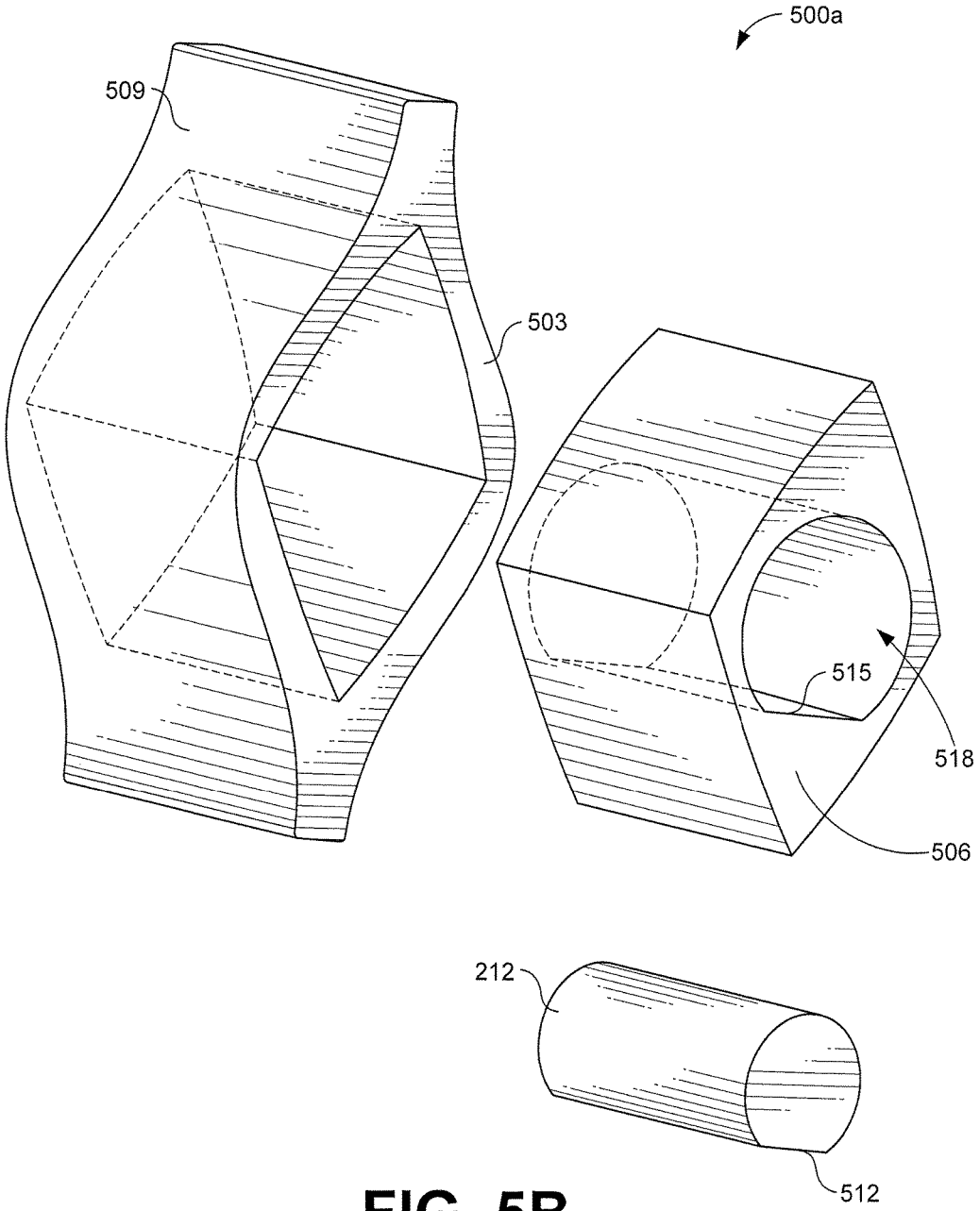

Referring next to FIG. 5B, shown is an ejector 500*a* for the ice making system 100 (FIG. 1) according to various example embodiments of the present disclosure. In FIG. 5B, the components in ejector 500*a* from FIG. 5A are shown separated and illustrated with a portion of an ejector shaft 212.

An ejector shaft 212 can be inserted through a keyed aperture 518 in the insert 506. The keyed aperture 518 can be shaped to correspond to the cross-sectional profile of the ejector shaft 212 and be sized to fit over the ejector shaft 212 with a tight clearance. The cross section of the ejector shaft 212 can have any cross-sectional profile geometry that will allow free rotation within the bore 418 of the ice formation tray 109 and be keyed so that the insert will rotate with the ejector shaft 212 when torque is applied. For example, the cross-sectional profile of the ejector shaft can be round with a flat side (D-shaped), square, hexagonal, or other shape that will allow free rotation about an axis.

In an embodiment, the ejector shaft 212 can be round having a flat side 512, referred to as a D-shaft, configured to prevent rotation of the ejector 203 relative to the ejector shaft 212 by contacting the flat side 515 of keyed aperture 518 of insert 506. The ejector shaft 212 can provide a greater rotational force to the insert 506 than if the ejector 203 were a single plastic material because of the increased density of the insert 506. The increased density of the insert 506 can prevent the ejector shaft 212 from stripping the flat side 515 of the ejector 203. The higher density material of the insert 506 can provide structural support to the unitary structure 503 when rotating to provide force on an ice piece 130.

The insert 506 can be formed or keyed in a variety of shapes to prevent the insert 506 from stripping when torqued with respect to the unitary structure 503. Because the unitary structure 503 has a lower density than the insert 506, the shape of the keyed intersection of the unitary structure 503 and the insert 506 can be designed to provide a greater support for shear forces than the keyed intersection between the ejector shaft 212 and the insert 506.

A cross section of the insert 506 can be keyed to the unitary structure 503 in the form of an elongated diamond shape, such as a rhombus. The cross section can be substantially in the shape of an elongated diamond in a plane perpendicular to the ejector shaft 212. In some embodiments, the elongated diamond shape can have beveled sides. For example, the sides of the insert 506 can be beveled to provide a thicker material nearest the center of the beveled side that corresponds to the thickest portion of the ejector shaft 212. In some embodiments, the cross section of the elongated diamond shape can have sides that are slightly concave or convex. In other embodiments, the cross section of the elongated diamond shape can have straight sides. The beveled surface 509 can correspond to an obtuse angle of the insert 506.

Figure 6A:
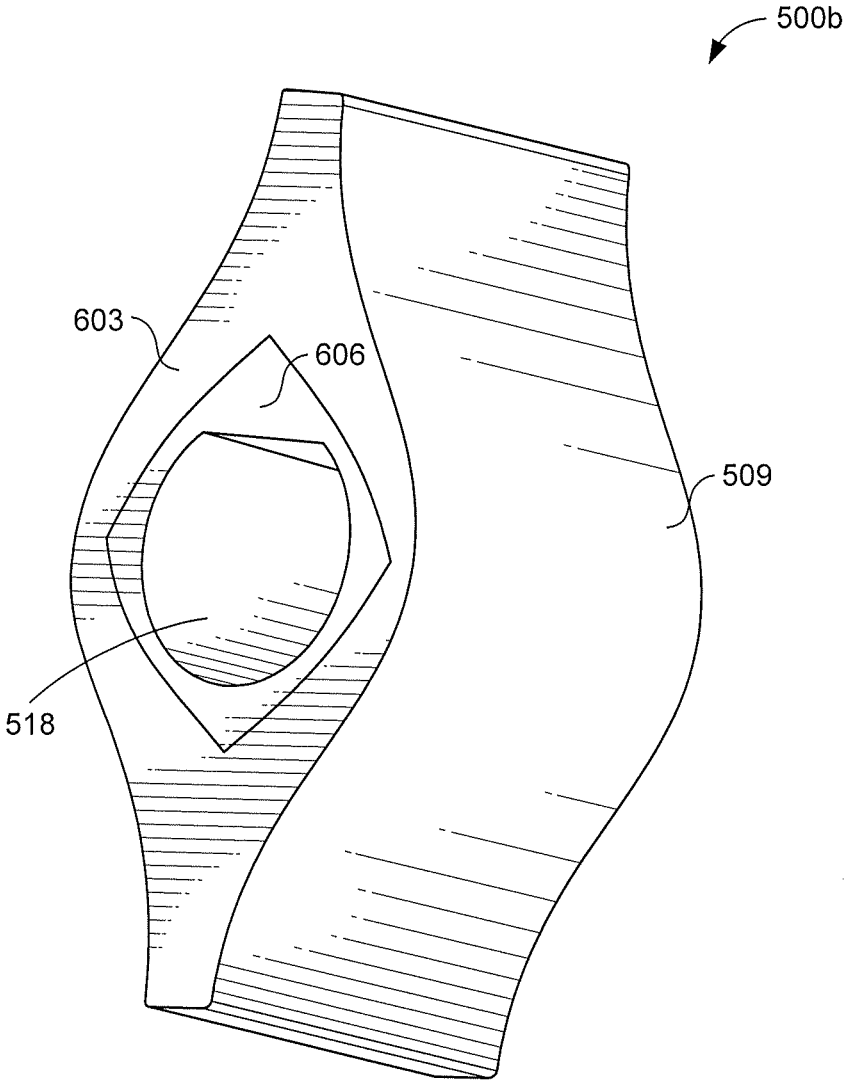
FIGS. 6A-6B illustrate an example of an ejector configured for an insert with a substantially square shaped cross section to be mounted on an ejector shaft of FIG. 3, according to various embodiments of the present disclosure.

With reference to FIG. 6A, shown is an ejector 500*b* according to various embodiments of the present disclosure. The ejector 500*b* can include a unitary structure 603 and an insert 606. The ejector 500*b* can be inserted in one of four different orientations into the unitary structure. The insert 606 is made from a different material from the unitary structure 603. In some embodiments, the insert 606 is made of a material with a higher density than the unitary structure 603. The insert 606 can be a metal alloy or other material. The unitary structure 603 can be made of a plastic, rubber, polymer, or other material. According to one embodiment, the insert 606 is placed into an ejection mold, and the unitary structure 603 is formed by injecting a material around the insert 606. In another embodiment, the insert 606 is pressed into the unitary structure 603.

Figure 6B:
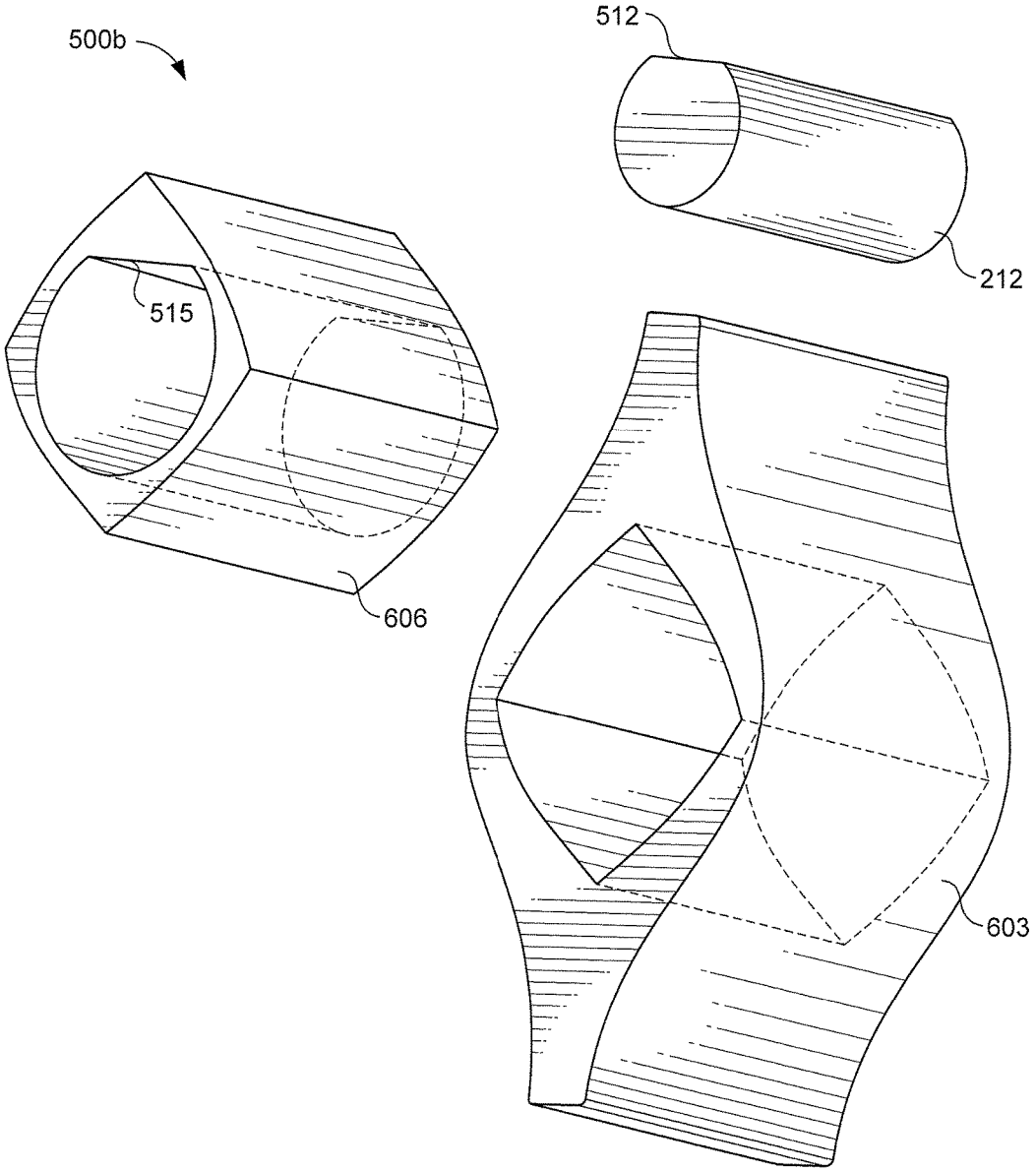

With reference to FIG. 6B, shown is an ejector 500*b* according to various example embodiments of the present disclosure. In FIG. 6B, the components in ejector 500*b* from FIG. 6A are shown separated and illustrated with a portion of an ejector shaft 212. The insert 606 can have a substantially square cross section in a direction perpendicular to the ejector shaft 212. In some embodiments, the edges of the cross section can be straight, while in others the edges can be curved. According to one embodiment, the ejector 500*b* is inserted in a common orientation relative to one another. In one example, a flat side 515 can be oriented to either the left, right, top, or bottom of the unitary structure 603, and all flat sides 515 are oriented either to the top or bottom, or to the right and left, to ensure all ejectors 500*b* are oriented in the same dimension with respect to the ejector shaft 212.

Figure 7A:
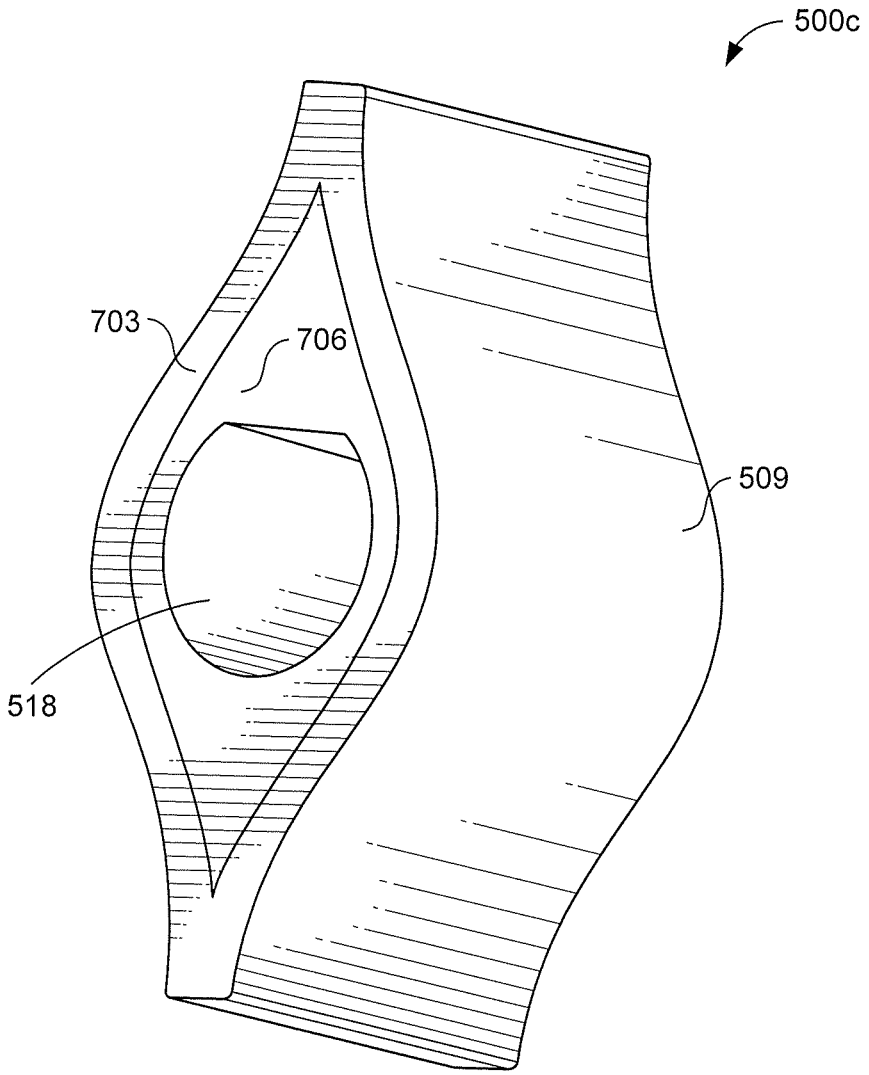
FIGS. 7A and 7B illustrate an example of an ejector configured for an insert with two sides shaped similar to the beveled surface to be mounted on an ejector shaft of FIG. 3, according to various embodiments of the present disclosure.

With reference to FIG. 7A, shown is an ejector 500*c* according to various embodiments of the present disclosure. The ejector 500*c* can include a unitary structure 703 and an insert 706. The insert 706 can have two sides shaped similar to the beveled surface 509 of the unitary structure 703. In an embodiment, the thickness of the unitary structure 703 is substantially uniform for a large portion of each side.

The insert 706 is made from a different material from the unitary structure 703. In some embodiments, the insert 706 is made of a material with a higher density than the unitary structure 703. The insert 706 can be a metal alloy or other material. The unitary structure 703 can be made of a plastic, rubber, polymer, or other material. According to one embodiment, the insert 706 is placed into an ejection mold, and the unitary structure 703 is formed by injecting a material around the insert 706. In another embodiment, the insert 706 is pressed into the unitary structure 703. The higher density material of the insert 706 can provide structural support to the unitary structure 703 when rotating to provide force on an ice piece 130. In one embodiment, a plastic unitary structure 703 can provide a greater force based on a metal insert 706.

Figure 7B:
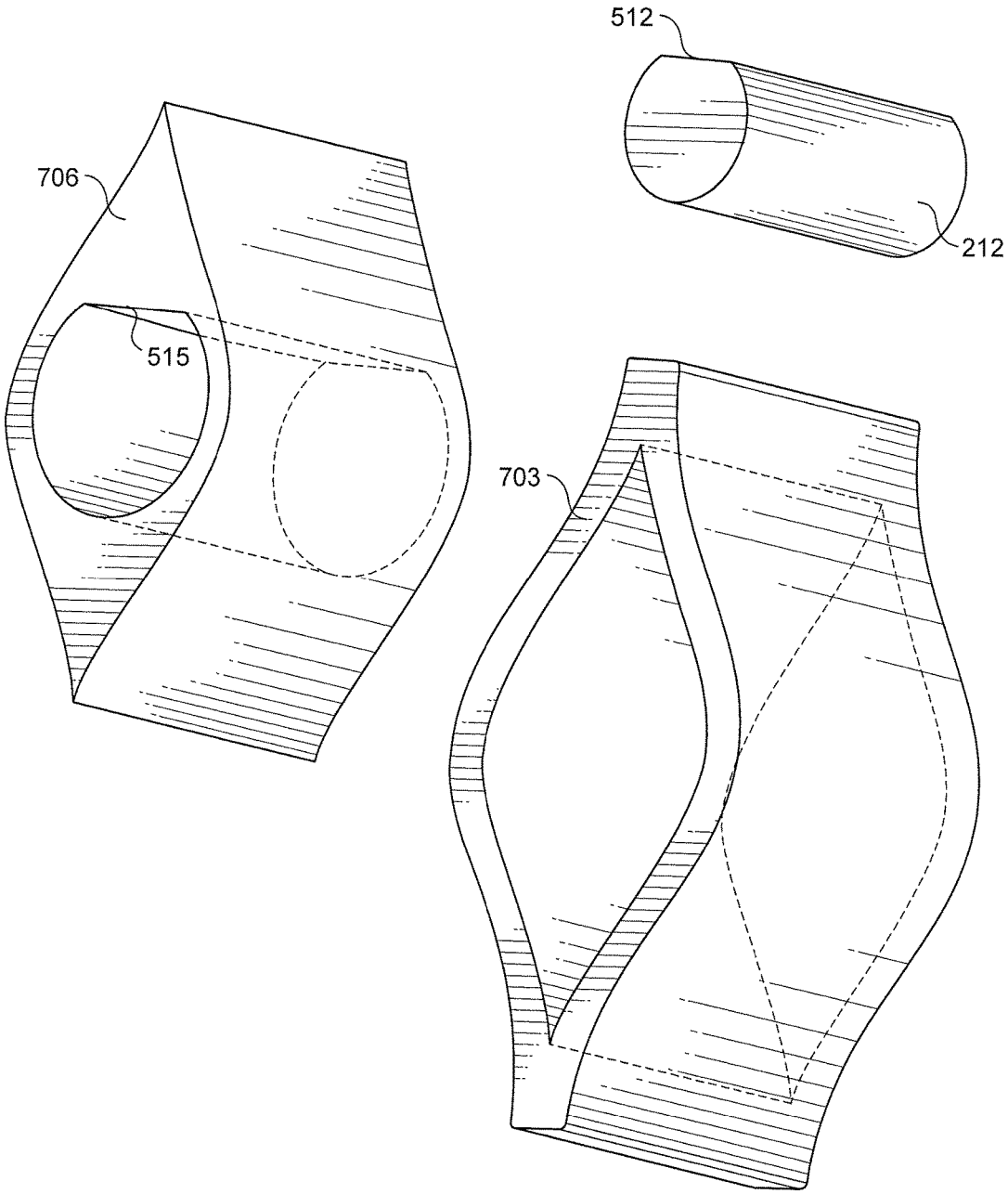

With reference to FIG. 7B, shown is an ejector 500*c* according to various example embodiments of the present disclosure. In FIG. 7B, the components in ejector 500*c* from FIG. 7A are shown separated and illustrated with a portion of an ejector shaft 212.

Figure 8A:
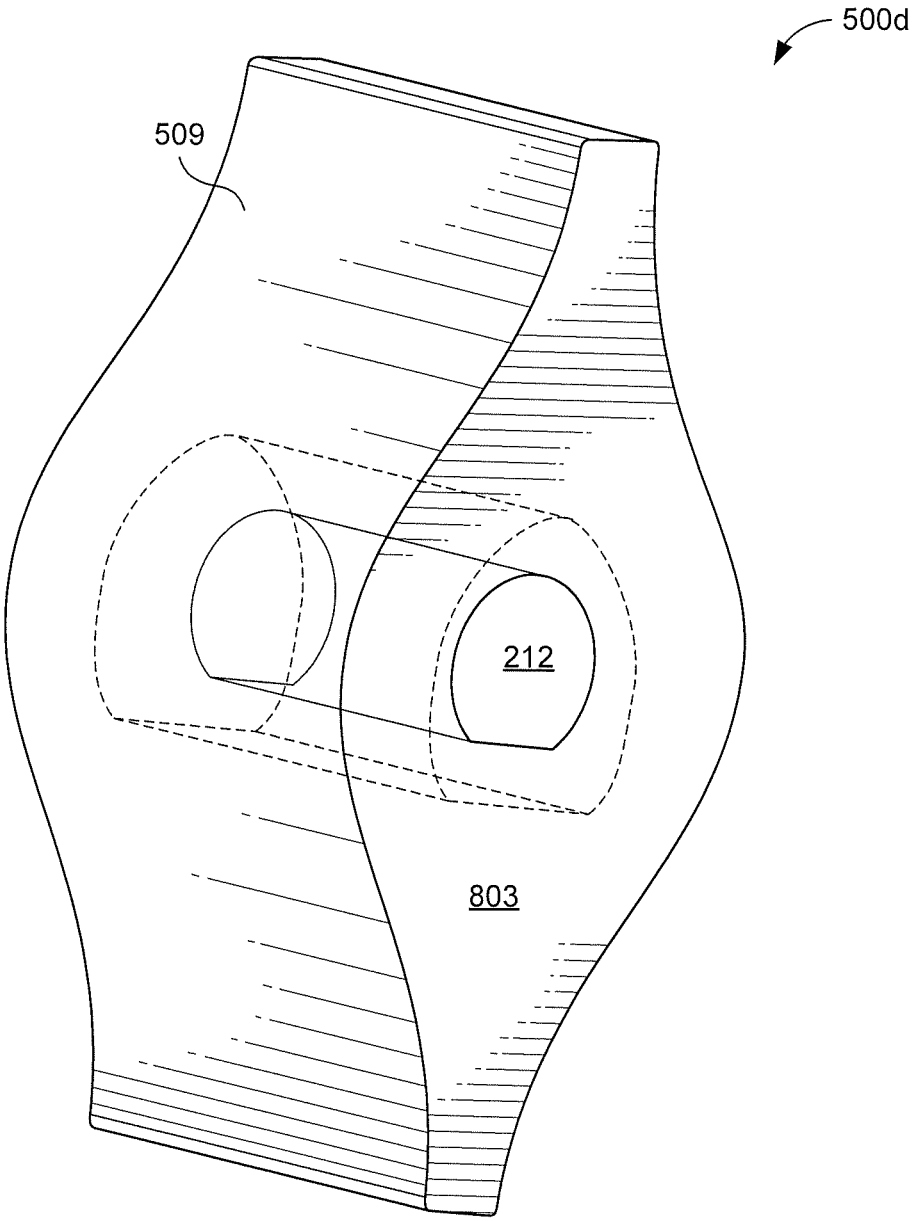
FIGS. 8A and 8B illustrate an example of an ejector configured for a substantially D-shaped insert to be mounted on an ejector shaft of FIG. 3, according to various embodiments of the present disclosure.

With reference to FIG. 8A, shown is an ejector 500*d* according to various embodiments of the present disclosure. The ejector 500*d* can include a unitary structure 803 and an insert 806. In some embodiments, the insert 806 is made of metal, which requires a higher force to detach ice from. In this embodiment, if water passes between the ejector 500*d* and the first partial bevel 206, the second partial bevel 209, the divider 409, or the divider 412, than the water will contact the side component 809 rather than the insert 806 to minimize the force needed to dislodge ice pieces 130. The side component 809 can be included in any other embodiment of an ejector 203 discussed herein, such as, for example, ejector 500*a-e*.

In some embodiments, the insert 806 is made of a material with a higher density than the unitary structure 803. The insert 806 can be a metal alloy or other material. The unitary structure 803 can be made of a plastic, rubber, polymer, or other material. According to one embodiment, the insert 806 is placed into an ejection mold, and the unitary structure 803 is formed by injecting a material around the insert 806. In another embodiment, the insert 806 is pressed into the unitary structure 803. The higher density material of the insert 806 can provide structural support to the unitary structure 803 when rotating to provide force on an ice piece 130. In one embodiment, a plastic unitary structure 803 can provide a greater force based on a metal insert 806.

Figure 8B:
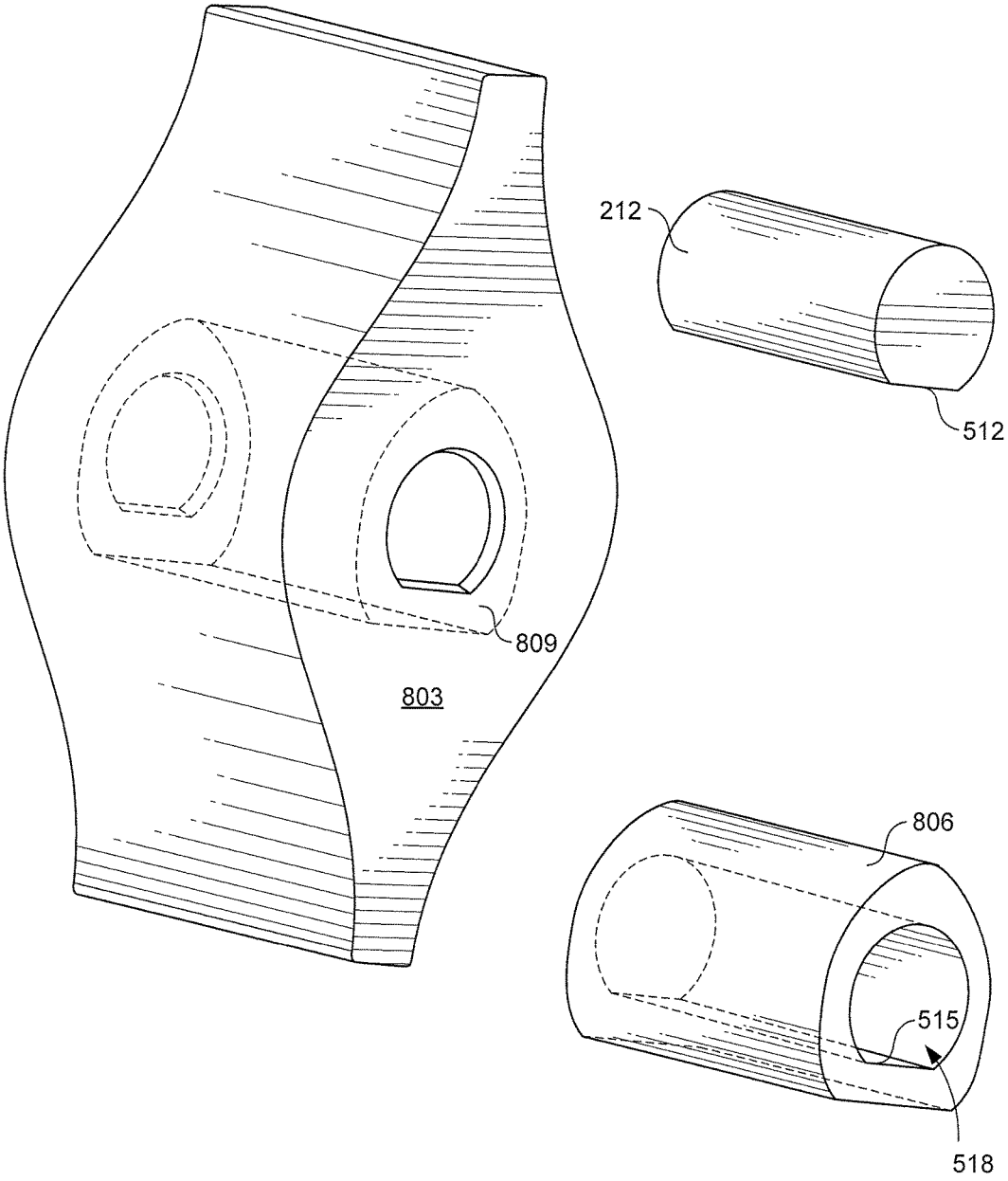

With reference to FIG. 8B, shown is an ejector 500*d* according to various example embodiments of the present disclosure. In FIG. 8B, the components in ejector 500*d* from FIG. 8A are shown separated and illustrated with a portion of an ejector shaft 212. The unitary structure 803 can include a side component 809 that covers two side portions of the insert 806 corresponding to the keyed aperture 518 in the ejector 500*d*. The side components 809 can prevent water from contacting the insert 806. The insert 806 can have a D-shaped cross section in a direction perpendicular to the ejector shaft 212. The D-shaped shape can have rounded corners. In some embodiments, the edges of the cross section can be straight, while in others the edges can be curved.

Figure 9A:
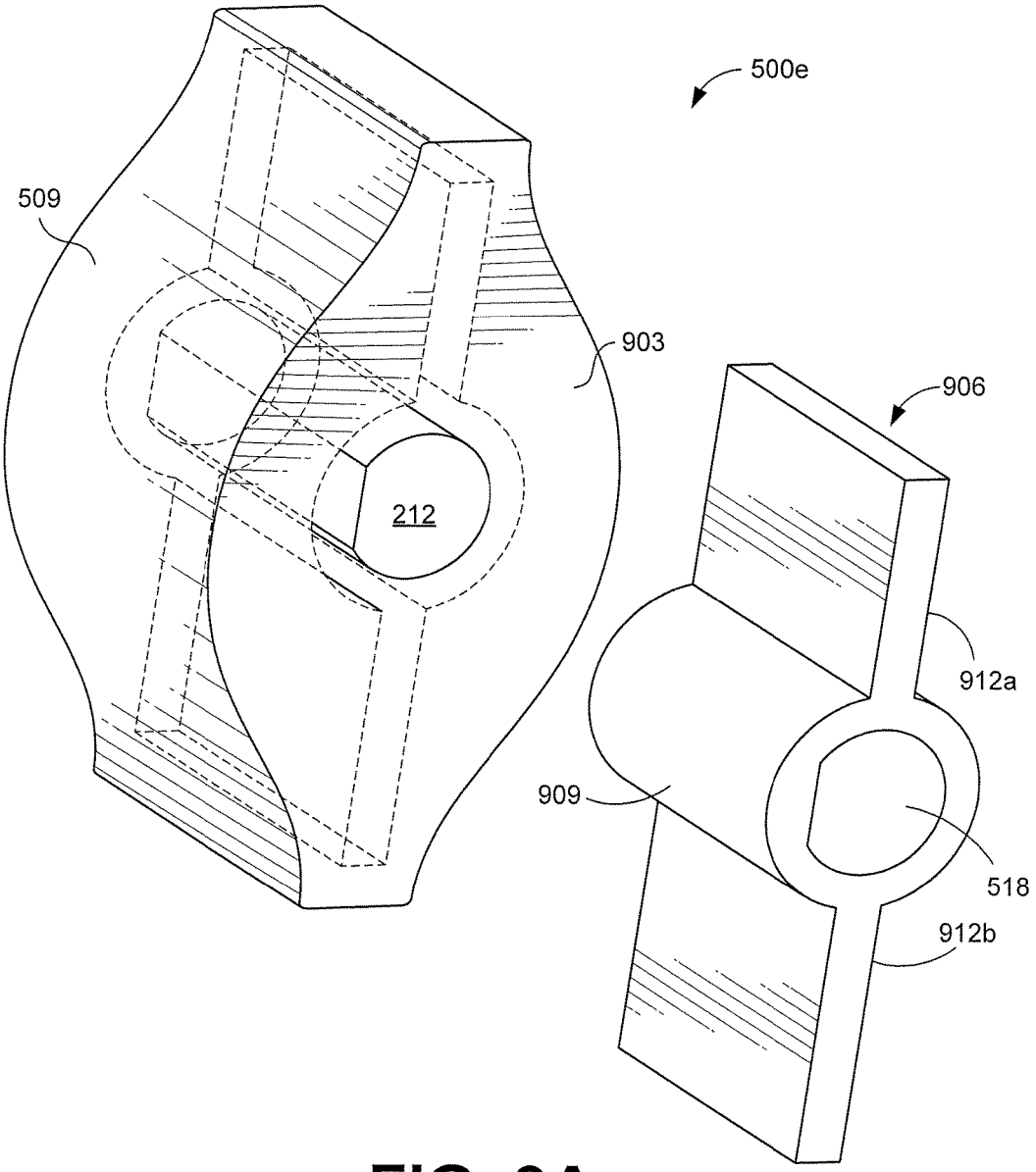
FIGS. 9A-9C illustrate an example of an ejector configured for a paddle shaped insert to be mounted on an ejector shaft of FIG. 3, according to various embodiments of the present disclosure.

With reference to FIG. 9A, shown is an ejector 500*e* according to various embodiments of the present disclosure. The ejector 500*e* can include a unitary structure 903 and an insert 906. The ejector 500*e* can have a symmetrically balanced bevel shape with an insert 906 having an elongated shape. The insert 906 can have a substantially circular central portion 909 with a keyed aperture 518 and flat substantially rectangular extensions 912*a* and 912*b* radiating in the same plane from two sides of the circular central portion 909.

Figure 9B:
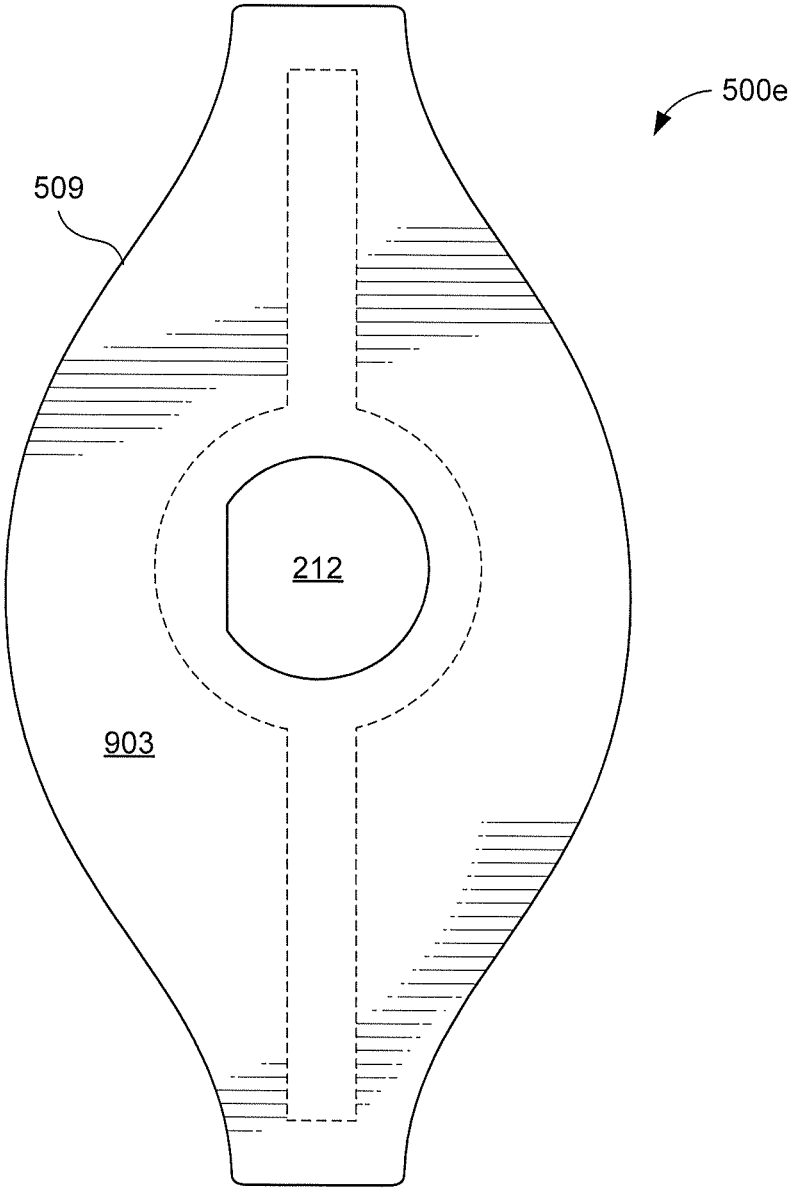

With reference to FIG. 9B, shown is an ejector 500*e* according to various embodiments of the present disclosure. FIG. 9B illustrates a cross section of ejector 500*e* in a plane perpendicular to the ejector shaft 212.

Figure 9C:
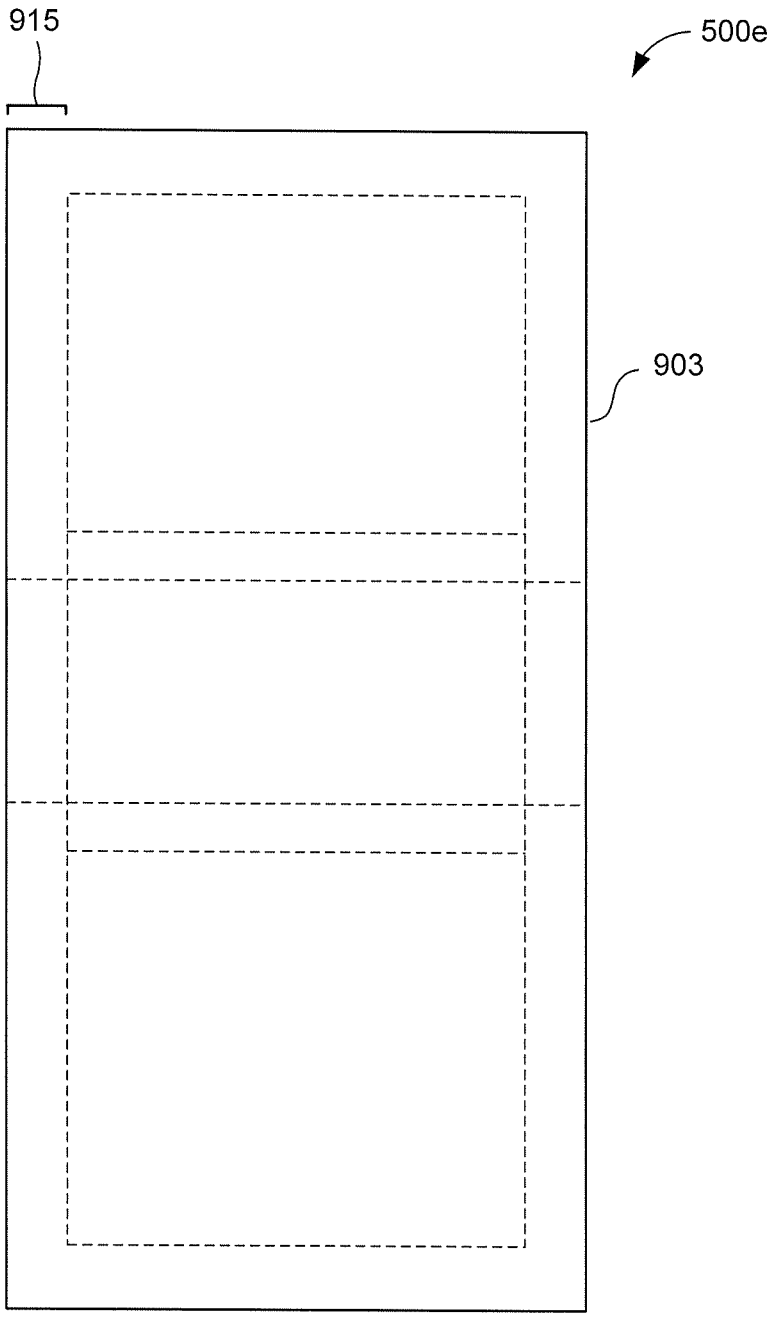

With reference to FIG. 9C, shown is an ejector 500*e* according to various embodiments of the present disclosure. FIG. 9C illustrates a cross section of ejector 500*e* in a plane parallel to the ejector shaft 212, the insert 906 can be substantially rectangular, fitting within the unitary structure 903. The insert 906 can have a width that is shorter than a width of the ejector 500*e* on the plane parallel to the ejector shaft 212. The widths can differ such that ejector material surrounds the insert 906 by a distance 915. In some embodiments, the distance 915 is 5% of the total width of the ejector 500*e*. In other embodiments, the distance 915 is at least 3 millimeters.

Figure 10B:
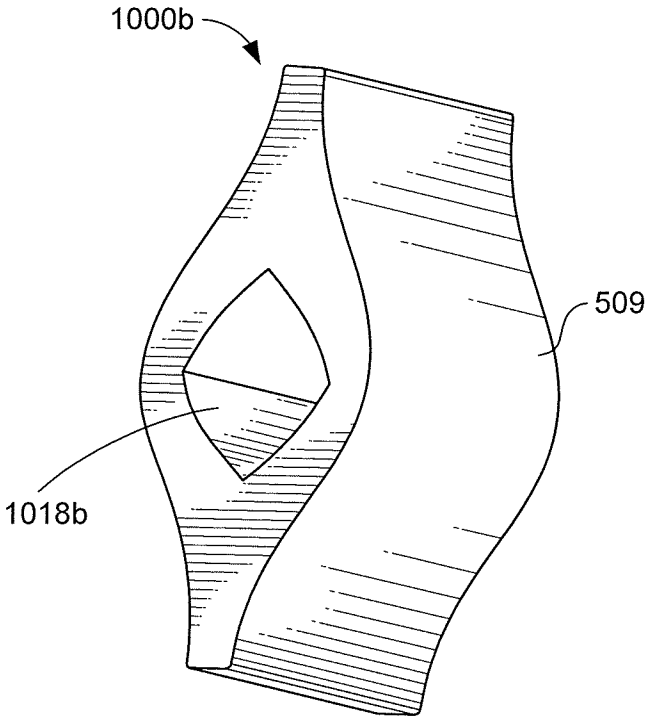
FIGS. 10A and 10B illustrate examples of ejectors made without an insert, with an aperture shaped to correspond to the cross section of an ejector shaft, according to various embodiments of the present disclosure.
Figure 10A:
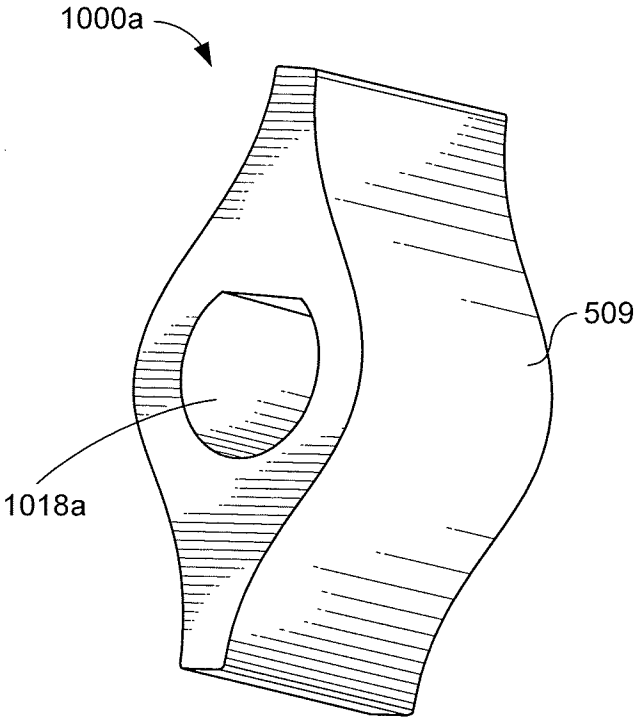

Turning now to FIG. 10A, shown is an ejector 1000*a* according to various embodiments of the present disclosure. The ejectors 203 can be made without an insert. An ejector 1000*a* can be formed with a keyed aperture 1018*a* having a beveled surface 509. The keyed aperture 1018*a* is D-shaped to correspond to a D-shaped ejector shaft 212.

With respect to FIG. 10B, shown is an ejector 1000*b* according to various embodiments of the present disclosure. The ejector 1000*b* can be formed with a keyed aperture 1018*b*. In one embodiment, the keyed aperture 1018*b* is square to accommodate a square ejector shaft 212. The shape of the keyed aperture 1018*b* and ejector shaft 212 can be in another shape, such as, for example, the shape of insert 503, 603, or 703. The square ejector shaft 212 can provide a greater torque to the ejector in comparison to the D-shaped ejector shaft 212 because of the shape of the shaft. The D-shaped ejector shaft 212 can strip the keyed aperture 1018*a* when a first torque is applied, and the square ejector shaft 212 can strip the keyed aperture 1018*b* when a second torque is applied. The first torque is less than the second torque.

Disjunctive language such as the phrase "at least one of X, Y, or Z," unless specifically stated otherwise, is otherwise understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

The invention claimed is:

1. A system, comprising:

an ice formation tray comprising a first side and a second side;

an ejector comprising a unitary structure and an insert, the unitary structure encompassing the insert on at least four sides; and an ejector shaft spanning between the first side and the second side of the ice formation tray, the ejector shaft passing through a bore in the insert of the ejector.

2. The system of claim 1, wherein the ejector shaft is configured to rotate between thirty and fifty degrees to pry an ice piece from the ice formation tray.

3. The system of claim 1, wherein the ejector shaft is configured to rotate forty degrees to pry an ice piece from the ice formation tray.

4. The system of claim 1, wherein the bore in the insert comprises a flat side in contact with a flat side of the ejector shaft, the flat side of the bore configured to prevent the ejector from rotating about the ejector shaft.

5. The system of claim 1, wherein a cross section of the insert is substantially trapezoidal in shape.

6. The system of claim 1, wherein the ice formation tray comprises an ice formation cell that is defined at least in part by a first wall and a second wall of the ice formation cell, where the ejector spans at least 40% of a space between the first wall and the second wall, and wherein the first wall is substantially parallel to the second wall.

7. The system of claim 6, wherein the ejector abuts the first wall and the second wall.

8. The system of claim 1, further comprising a water supply configured to generate a water stream that travels substantially parallel to a first wall and a second wall.

9. The system of claim 1, wherein the unitary structure encompasses the insert on all sides and comprises a bore on a side and a bore on a another side, wherein the bore of the side and the bore of the other side are separated by the bore in the insert.

10. The system of claim 1, wherein the unitary structure comprises rubber and the insert comprises metal.

11. The system of claim 1, wherein a density of the insert is greater than a second density of the unitary structure.

12. The system of claim 1, wherein the unitary structure comprises two projections extending in opposite directions.

13. A system, comprising: an ice formation tray comprising a first wall substantially parallel to a second wall of an ice formation cell; an ejector spanning at least 40% of a space between the first wall and the second wall, wherein the ejector comprises a unitary structure and an insert, the unitary structure encompassing the insert on at least four sides and the insert; and an ejector shaft passing through an bore in the ejector.

14. The system of claim 13, wherein the ejector shaft rotates in a first direction a rotation amount between thirty and fifty degrees, rotates in another direction to return to a neutral position, and rotates in the other direction the rotation amount.

15. The system of claim 14, wherein the rotation amount is forty degrees.

16. The system of claim 13, further comprising a stationary panel comprising a flat surface, the stationary panel spanning at least a distance between the first wall and the second wall, and the stationary panel being substantially perpendicular to the first wall and the second wall.

17. The system of claim 13, wherein the ejector abuts the first wall and the second wall.

18. The system of claim 13, wherein the ejector shaft is configured to rotate about an axis that extends through the ice formation tray.

19. A method, comprising: providing a water stream to an ice formation cell comprising a first wall substantially parallel to a second wall of the ice formation cell, an ejector spanning at least 40% of a space between the first wall and the second wall, wherein the ejector comprises a unitary structure and an insert, the unitary structure encompassing the insert on at least four sides and the insert; and freezing a portion of the water stream that makes direct contact with a refrigerant tube, thereby making an ice piece.

20. The method of claim 19, wherein the ejector abuts the first wall and the second wall at an obtuse angle.

21. The method of claim 19, further comprising rotating an ejector shaft that passes through a bore in the first wall of the ice formation cell, a bore in the ejector, and a bore in the second wall of the ice formation cell to remove the ice piece from the ice formation cell.

22. The method of claim 19, wherein the ejector is fixed relative to an ejector shaft based at least in part on a first flat surface of the insert contacting a second flat surface of the ejector shaft.

23. The method of claim 19, further comprising:

supplying a decompressed refrigerant through the refrigerant tube to freeze the portion of the water stream; and supplying a compressed refrigerant through the refrigerant tube to heat the ice piece at a surface touching the refrigerant tube, wherein an ejector shaft is turned subsequent to supplying the compressed refrigerant.

24. The method of claim 19, further comprising providing another water spray to the ice formation cell to assist in ejecting the ice piece.

* * * * *